US006978888B1

(12) United States Patent
Sanders

(10) Patent No.: US 6,978,888 B1
(45) Date of Patent: Dec. 27, 2005

(54) BOTTLE CARRIER WITH HANDLE AND PULL TAB

(75) Inventor: Denise Sanders, Marietta, GA (US)

(73) Assignee: Display Industries, LLC., Norcross, GA (US)

( * ) Notice: Subject to any disclaimer, the term of this patent is extended or adjusted under 35 U.S.C. 154(b) by 0 days.

(21) Appl. No.: 10/925,588

(22) Filed: Aug. 25, 2004

(51) Int. Cl.[7] ..... B65D 75/00
(52) U.S. Cl. ..... 206/147; 206/427
(58) Field of Search ..... 206/162, 163, 206/165, 145, 147, 150, 151, 156, 158, 427; 294/87.2

(56) References Cited

U.S. PATENT DOCUMENTS 3,225,959 A * 12/1965 Jamison ..... 206/143
3,608,949 A * 9/1971 Owen ..... 294/87.2
3,698,550 A * 10/1972 Graser ..... 206/140
3,727,754 A * 4/1973 Cunningham ..... 206/150
5,290,083 A * 3/1994 Rissley ..... 294/87.2
5,695,232 A * 12/1997 Tipp ..... 294/87.2
5,944,174 A * 8/1999 Marco ..... 206/148
6,779,655 B2 * 8/2004 Olsen et al. ..... 206/150

* cited by examiner

*Primary Examiner*—Shian T. Luong
(74) *Attorney, Agent, or Firm*—John L. James

(57) ABSTRACT

A carrier for a plurality of beverage containers has a carrier body, means for hand carrying the carrier, and pull tabs. The carrier body has an outer periphery and defines a plurality of container openings with one container opening for each beverage container of the plurality of beverage containers. There is a plurality of pull tabs with one pull tab for each container opening of the plurality of container openings. Each pull tab extends from the outer periphery to an associated container opening and is connected to the associated opening by perforations extending from the associated opening to the outer periphery so that pulling the pull tab separates the body at the associated opening creating a path for container removal.

3 Claims, 2 Drawing Sheets

BOTTLE CARRIER WITH HANDLE AND PULL TAB

TECHNICAL FIELD OF THE INVENTION

This invention relates to a carrier for a plurality of beverage containers, particularly bottles.

BACKGROUND OF THE INVENTION

Beverage container carriers have been used for years to group six containers together. Typically, the carrier has two holes for the fingers to fit through to facilitate carrying the containers. Most notably, carriers are used for six standard sized beverage container; that is, six twelve-ounce containers. With the growth in popularity of bottled beverages, particularly water and non-carbonated drinks, the containers have grown in size to twenty ounces or more. The added weight makes finger holes painful to use. One solution is to group only four containers together to reduce weight; however, four twenty-ounce containers still weigh more than a twelve-ounce six-pack. Accordingly, it will be appreciated that it would be highly desirable to have a carrier for use with a four-pack of bottles that does not cause hurt or harm to the fingers.

Another problem with container carriers is removing a container. Removing a single can from a six-pack plastic loop carrier, for example, is accomplished by grasping a single can and pulling or twisting the can to remove it from its loop. The twisting and pulling often stretches the plastic loops undesirably causing more than one can to dislodge. The twisting and pulling can also agitate the contents of the container causing uncontrolled fizzing and spurting of the contents when the container is opened. Accordingly, it will be appreciated that it would be highly desirable to have a carrier for use with a four-pack of bottles that does not promote uncontrolled fizzing and spurting of the contents when the container is removed from the carrier and opened.

SUMMARY OF THE INVENTION

The present invention is directed to overcoming one or more of the problems set forth above. Briefly summarized, according to one aspect of the invention a carrier for a plurality of beverage containers comprises a carrier body having an outer periphery and defining a plurality of container openings with one container opening for each beverage container of the plurality of beverage containers; means for hand carrying the carrier; and a plurality of pull tabs with one pull tab for each container opening of the plurality of container openings. Each the pull tab extends from the outer periphery to an associated container opening and is connected to the associated opening by perforations extending from the associated opening to the outer periphery so that pulling the pull tab separates the body at the associated opening creating a path for container removal.

The carrier can be used with a four-pack of bottles and the handhold provides a large gripping area to prevent hurt or harm to the fingers. The pull tabs allow easy access to the bottles so that bottles can be removed one at a time without promoting fizzing or spurting of the contents of the bottle.

According to another aspect of the invention, a carrier for a plurality of beverage containers comprises a piece of flexible material having a bifurcated first end portion, a bifurcated second end portion and a middle portion connecting the first and second end portions. The bifurcated first end portion defines first and second straps with the first strap having a first container opening and the second strap having a second container opening. The bifurcated second end portion defines third and fourth straps with the third strap having a third container opening and the fourth strap having a fourth. The bifurcated second end portion is adapted to fit through the bifurcated first end portion and form a handhold loop in the middle portion. The handhold loop spreads the weight over all the fingers or the hand so that the fingers are not hurt or harmed during use.

The middle can be folded into a handhold loop for comfortably carrying the heavy bottles with minimal spacing between the upright bottles. The symmetric design of the carrier simplifies orienting and loading the carrier. The pull tabs facilitate easy removal of one bottle at a time.

According to yet another aspect of the invention, a carrier for a plurality of beverage containers comprises a piece of flexible material having an interior portion, an end portion and an outer periphery about the interior portion and end portion. The interior portion defines a plurality of container openings with one container opening for each beverage container of the plurality of beverage containers. Each container opening is spaced from adjacent container openings and joined thereto by straps.

The end portion defines a handhold opening. The handhold spreads the weight over all the fingers or the hand so that the fingers are not hurt or harmed during use. The pull tabs facilitate easy, non-gitating removal of one bottle at a time.

These and other aspects, objects, features and advantages of the present invention will be more clearly understood and appreciated from a review of the following detailed description of the preferred embodiments and appended claims, and by reference to the accompanying drawings

DETAILED DESCRIPTION OF THE PREFERRED EMBODIMENTS

Figure 1:
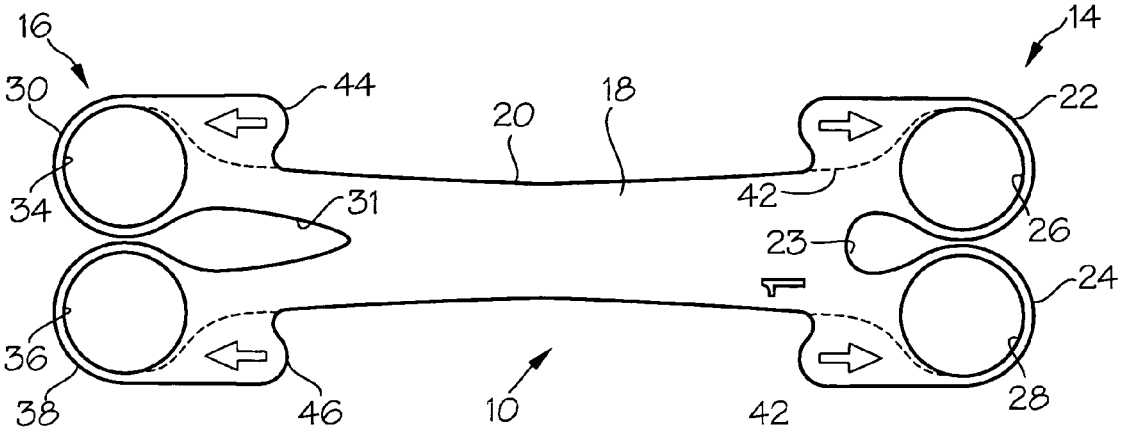
FIG. 1 is a plan view of another preferred embodiment of a bottle carrier incorporating a handle strap and pull tab according to the present invention.
Figure 2:
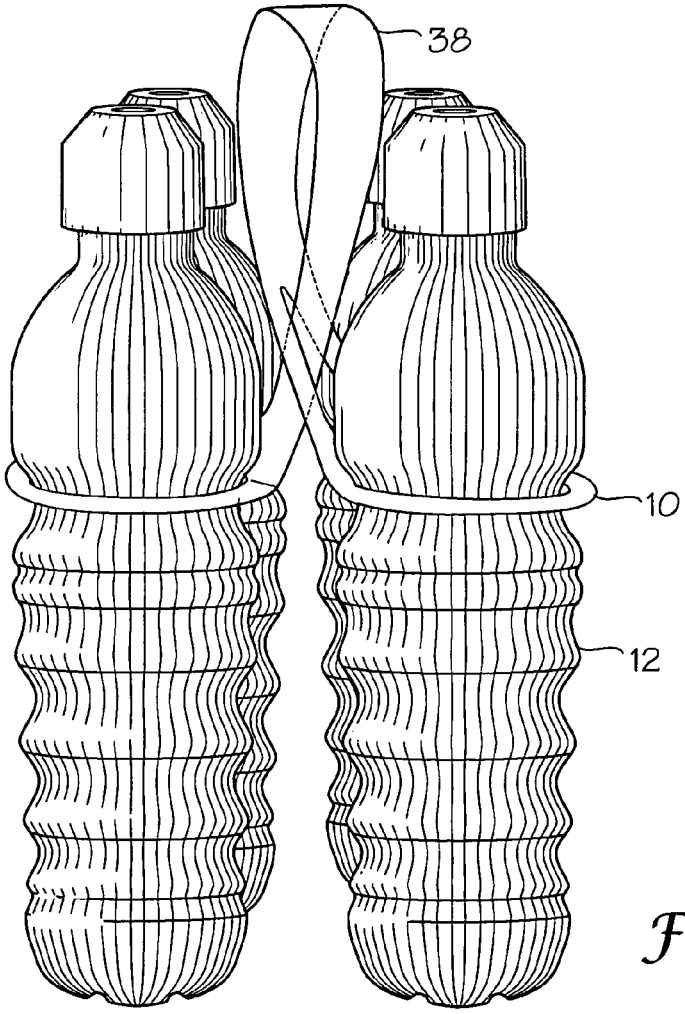
FIG. 2 is a perspective view of the bottle carrier of FIG. 1 with bottles.

Referring to FIGS. 1–2, a carrier 10 is illustrated for hand carrying a plurality of beverage containers 12. Carrier 10 is preferably constructed of a piece of flexible material forming a carrier body that has a bifurcated first end portion 14, a bifurcated second end portion 16, a middle portion 18 connecting the first and second end portions 14, 16, and an outer periphery 20. Bifurcated first end portion 14 defines first and second straps 22, 24 wherein first strap 22 has a first container opening 26 and second strap 24 has a second container opening 28. Straps 22, 24 preferably define an opening 23 between them. Bifurcated second end portion 16 defines third and fourth straps 30, 32 wherein third strap 30 has a third container opening 34 and fourth strap 32 has a fourth container opening 36. Straps 30, 32 preferably define an elongated opening 31 between them.

Bifurcated second end portion 16 is adapted to fit through bifurcated first end portion 14 and form a handhold loop 38 in middle portion 18. The middle portion 18 is a central body panel that can fold into a loop to thereby form a handhold. Loop 38 is formed by slipping bifurcated first end portion 14 through elongated opening 31 in the bifurcated second end portion 16.

There is a pull tab 40, 42, 44, 46 for each of the straps 22, 24, 34 36 and associated container openings 26, 28, 30, 32. Each pull tab extends from the outer periphery to an associated strap and opening and is connected thereto by perforations extending from the associated opening to the outer periphery so that pulling the pull tab separates the strap at the associated opening creating a path for container removal. For example, pull tab 40 extends from outer periphery 20 to its associated strap 22 and opening 26, and is connected thereto by perforations 42 that extend from opening 26 to outer periphery 20 so that pulling pull tab 40 separates strap 22 at opening 26 creating a path for removal of a single container without disturbing remaining three containers.

Carrier 10 is preferably formed by stamping a single piece of flexible plastic material to form the straps and openings. Paper or other material could be used but plastic is preferred for its resistance to moisture and ability to being easily formed into a handhold loop without creasing or crinkling which could weaken the material making it more susceptible to tearing.

Figure 3:
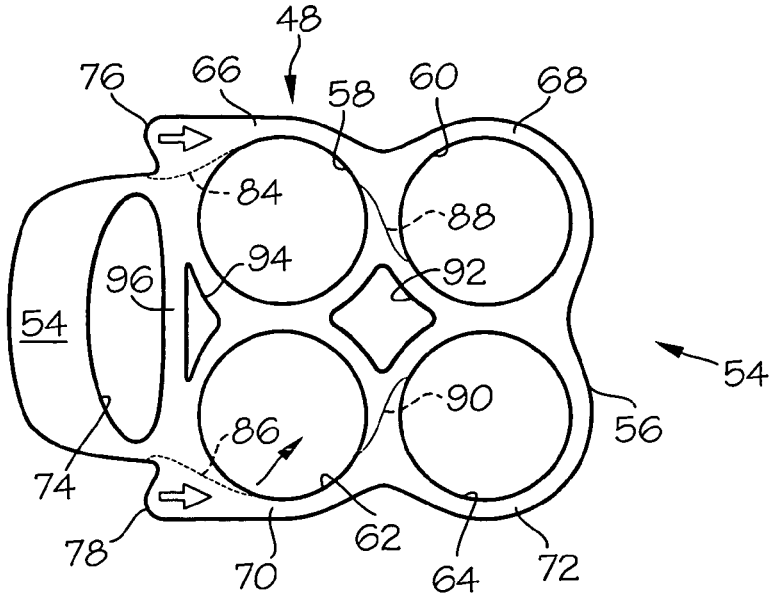
FIG. 3 is a plan view of a preferred embodiment of a bottle carrier incorporating a handle and pull tab according to the present invention.
Figure 4:
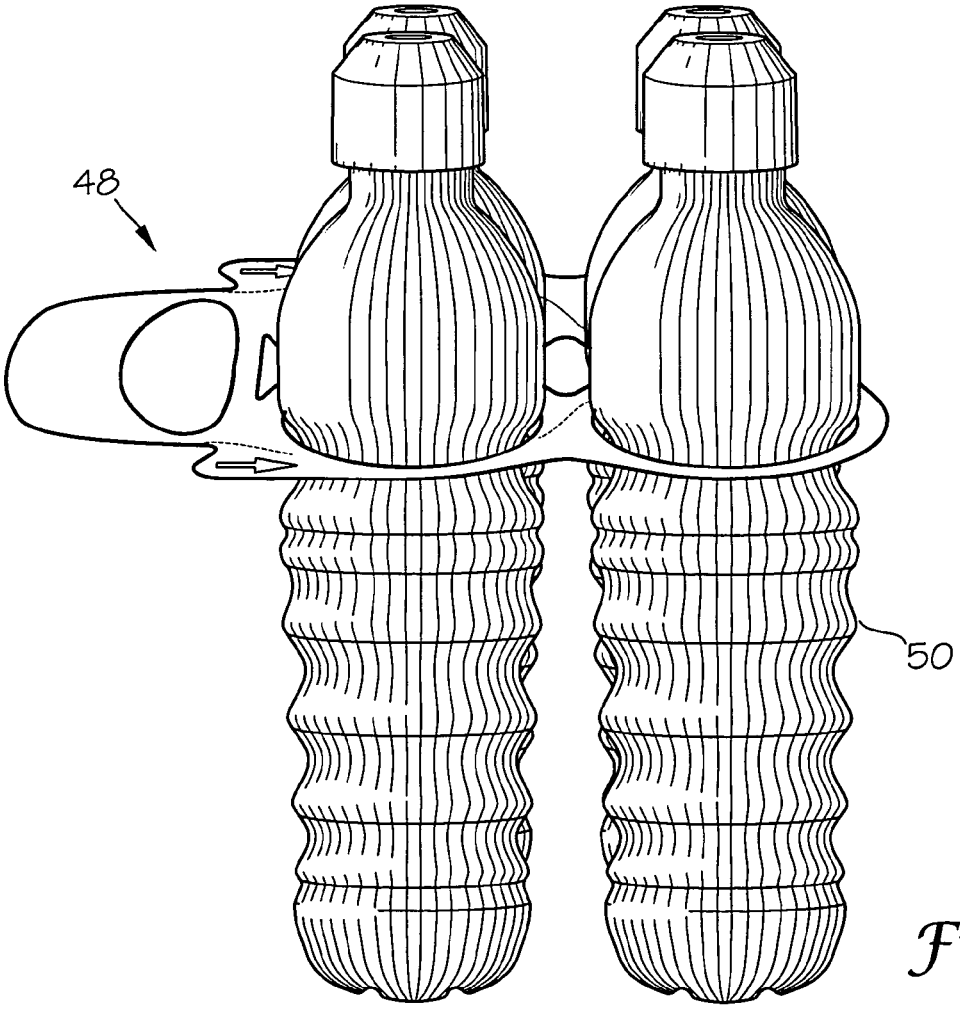
FIG. 4 is a perspective view of the bottle carrier of FIG. 3 with bottles.

Referring now to FIGS. 3–4, a carrier 48 for hand carrying a plurality of beverage containers 50 is illustrated. Carrier 48 is preferably constructed of a piece of flexible material forming a carrier body panel that has an interior portion 52, an end portion 54 and an outer periphery 56 about interior portion 52 and end portion 54. Interior portion 52 defines a plurality of container openings 58, 60, 62, 64 so that there is one container opening for each beverage container of the plurality of beverage containers 50. As illustrated, there are four container openings arranged in two rows of two openings. Each container opening is spaced from adjacent container openings and joined thereto by straps 66, 68, 70, 72. As illustrated, straps 66 and 68 share a common area, and straps 70 and 72 share a common area. The common areas are perforated. End portion 54 defines a handhold opening 74 as a means for hand carrying the carrier. Handhold opening 74 is preferably an elongated oval.

There is a pull tab 76, 78, for each pair of strap 66, 68 and 70, 72 and associated container opening 58, 60 and 62, 64. Each pull tab extends from outer periphery 56 to an associated strap and opening and is connected thereto by perforations 84, 86, that extend from the associated opening to the outer periphery so that pulling the pull tab separates the strap at the associated opening creating a path for container removal. For example, pull tab 78 extends from outer periphery 56 to its associated strap 70 and opening 62, and is connected thereto by perforations 86 that extend from opening 62 to outer periphery 56 so that pulling pull tab 78 separates strap 70 at opening 62 creating a path for removal of a single container without disturbing remaining containers. The container in opening 58 is preferably removed first by using pull tab 76. The second container to be removed may be in either opening 62 or opening 60. The container in opening 60 is accessed by again pulling on pull tab 76 to separate strap 68 at the perforation 88 in the common area between straps 66 and 68. Similarly, the container in opening 64 is accessed by again pulling on pull tab 78 to separate strap 72 at the perforation 90 in the common area between straps 70 and 72.

Carrier 48 is preferably formed by stamping a single piece of flexible plastic material to form the straps and openings. Paper or other material could be used but plastic is preferred for its resistance to moisture and easy recycling ability. Carrier 48 also has torsion opening 92 and force directing opening 94 that are stamped along with the other container openings and handhold opening. The interior portion 52 defines torsion opening 92 so that torsion opening 92 is spaced from all four adjacent container openings and joined thereto by straps in the common areas. The interior portion 52 also defines force directing opening 94 so that force directing opening 94 is spaced from adjacent container openings 58, 62 and joined thereto by straps 66, 70. Force directing opening 94 is adjacent end portion 54. End portion 54 defines handhold opening 74 so that handhold opening 74 is spaced from force directing opening 94 and joined thereto by an end strap 96.

Torsion opening 92 is centrally located between the container openings and allows the carrier body to flex somewhat when a container is inserted. Flexing is also useful after loading when the containers rest on uneven surfaces. As illustrated, torsion opening 92 is generally diamond shaped with the sides of the diamond having a slight curvature, although circular or other shapes could be used. The diamond shape is preferred because it allows for greater surface area removal while maintaining maximum uniform strap thickness.

Force directing opening 94 is centrally located between the handhold opening and the two container openings nearest the handle. Forces encountered when lifting the carrier by the handle are directed around opening 94 to the upper straps 66, 70. Opening 94 is preferably shaped in a triangular configuration.

It can now be appreciated that a carrier for a plurality of beverage containers, particularly bottles, has been presented. The carrier comprises a carrier body having an outer periphery and defining a plurality of container openings wherein there is one container opening for each beverage container of the plurality of beverage containers. Means are provided for hand carrying the carrier which may take the form of a panel having a handhold wherein the panel is attached to one end of the carrier body, or a central body panel adapted to fold into a loop to thereby form a handhold. There is a pull tab for each container opening that extends from the outer periphery to the container opening and is connected to the opening by perforations extending from the opening to the outer periphery so that pulling the pull tab separates the body at the associated opening creating a path for removal of a single container without agitation.

While the invention has been described with particular reference to the preferred embodiments, it will be understood by those skilled in the art that various changes may be made and equivalents may be substituted for elements of the preferred embodiments without departing from invention. For example, while the pull tabs have been described as extending to the outer periphery, they could extending along the body as long as they enlarge the container opening sufficiently for easy container removal. And while the carrier has been described as being formed of plastic, paper could be used. It is accordingly intended that the claims shall cover all such modifications and applications as do not depart from the true spirit and scope of the invention.

ELEMENT LIST

10 carrier
12 beverage containers
14 bifurcated first end portion
16 bifurcated second end portion
18 middle portion

20 outer periphery
22 first strap
24 second strap
26 first container opening
28 second container opening
30 third strap
32 fourth strap
34 third container opening
36 fourth container opening
38 handhold loop
40 first pull tab
42 second pull tab
44 third pull tab
46 fourth pull tab
48 carrier
50 beverage containers
52 interior portion
54 end portion
56 outer periphery
58 first container opening
60 second container opening
62 third container opening
64 fourth container opening
66 first strap
68 second strap
70 third strap
72 fourth strap
74 handhold opening
76 first pull tab
78 second pull tab
80 third pull tab
82 fourth pull tab
84 first perforation
86 second perforation
88 third perforation
90 fourth perforation
92 torsion opening
94 force directing opening
96 end strap What is clamed is:

1. A carrier for a plurality of beverage containers, comprising:

an elongated carrier body having an outer periphery, first and second end portions, and a single flexible central body panel connected to said first and second end portions and extending therebetween, said flexible central body panel being adapted to fold into a loop thereby forming a handhold, said carrier body defining at least one container opening in said first end portion near said outer periphery, said carrier body defining at least one container opening in said second end portion near said outer periphery; and a plurality of pull tabs with one pull tab for each container opening of said plurality of container openings, each said pull tab extending from said outer periphery to an associated container opening and being connected to said associated opening by perforations extending from said associated opening to said outer periphery so that pulling said pull tab separates said body at said associated opening creating a path for container removal.

2. A carrier for a plurality of beverage containers, comprising:

a piece of flexible material having a bifurcated first end portion, a bifurcated second end portion, a middle portion connecting said first and second end portions, and an outer periphery;

said bifurcated first end portion defining first and second straps, said first strap having a first container opening and said second strap having a second container opening;

said bifurcated second end portion defining third and fourth straps, said third strap having a third container opening and said fourth strap having a fourth container opening; and said bifurcated second end portion being adapted to fit through said bifurcated first end portion and form a handhold loop in said middle portion.

3. A carrier, as set forth in claim 2, including a pull tab for each of said straps and associated container openings, each said pull tab extending from said outer periphery to an associated strap and opening and being connected thereto by perforations extending from said associated opening to said outer periphery so that pulling said pull tab separates said strap at said associated opening creating a path for container removal.

* * * * *